United States Patent [19]

Green

[11] 4,163,312

[45] Aug. 7, 1979

[54] METHOD AND MEANS FOR PRODUCING ROLLED METAL PRODUCTS

[76] Inventor: Robert B. Green, 2106 Walnut La., Vista, Calif. 92083

[21] Appl. No.: 905,739

[22] Filed: May 15, 1978

[51] Int. Cl.[2] ..... B22D 11/126

[52] U.S. Cl. ..... 29/527.7; 164/270; 164/269; 29/33 C; 72/DIG. 12

[58] Field of Search ..... 29/527.7, 33 C, 527.6, 29/526.2, 526.3, 526.4, 526.5, 526.6; 72/DIG. 12; 164/269, 270

[56] References Cited

U.S. PATENT DOCUMENTS 3,753,288 9/1973 Orbon, Sr. ..... 29/527.7

*Primary Examiner*—Francis S. Husar
*Assistant Examiner*—V. K. Rising
*Attorney, Agent, or Firm*—Duane C. Bowen

[57] ABSTRACT

Metal melted and poured into molds, mounted on a conveyor, at a first station. Metal cools to rolling temperature during conveyance to second station where hydraulic ram ejects ingots from molds. Ingots are immediately fed to rolling mill. Molds have interior refractory linings. Embedded in linings are electrical resistance heating elements that heat exterior side surfaces of ingots, between first and second stations, to prevent those surfaces from reducing below rolling temperatures while interior temperatures of ingots reduce to levels suitable for rolling.

12 Claims, 7 Drawing Figures

10
26
30
32
12
34
28
36
42
16
14
66
68
70
3
40

14
50
76
74
42
72
70
68
66
48
56
58
60
62
64
46
40

14
20
38
46
48
68
64
70
66
16
36

42
50
14
64
66
62
68
46
56
58
60
40

70
42
72
46
68
62
48
66
14
60
58
64
72

METHOD AND MEANS FOR PRODUCING ROLLED METAL PRODUCTS

BRIEF SUMMARY OF THE INVENTION AND OBJECTIVES

My invention relates to an improvement in a method and means for producing rolled metal products that has a field of applications.

The prior method of producing rolled metal products was (a) to produce ingots or billets at one time and allow the same to cool and (b) at a later time (at the same place or another place) to reheat the ingot or billet to rolling temperature and roll a metal product. That process will be observed to be wasteful in using energy to reheat the metal to rolling temperature. In my invention, I have, first, perceived this waste, and, second, understood that such waste is not always necessary. The second statement should be studied. It's meaning is that just because there may be rolling operations wherein cooling/reheating is necessary does not mean that there aren't other sizeable operations wherein cooling/reheating is not necessary.

In other words, I perceived that my idea of avoidance of cooling/ reheating does not have to apply to all rolling operations in order to have commercial importance. My invention may have most of its application with iron and steel rolling. Looking particularly at iron and steel rolling, the industry is fragmented as to locations and sizes of rolling operations. Some of the rolling is done in locations like Pennsylvania, West Virginia and Ohio in connection with the giant so-called steel mills. Other rolling is done in locations as remote from that primary production area as Los Angeles. In a location like Los Angeles, some of the iron/steel rolling may be on large scale, but, for example, in the smaller industrial community of San Diego there are a number of small producers. In such Western U.S. locations, considerable rolling of reinforcing iron or steel, for example, may be done primarily from scrap iron/steel but other production in the West may be from ore transported into that area.

I am dealing with a continuous process from ingot pouring to product rolling. I am not offering that such a continuous processing applies to all rolling production but I have conceived that continuous processing has a sizable and significant field of application.

The objectives of my invention include the devising of an economically improved method and means for producing rolled metal products, namely avoiding the waste of letting ingots or billets cool after pouring and later reheating them to rolling temperatures. Other objectives including providing the other things necessary for a successful method and means for producing rolled metal products, i.e., matters concerning molds and their handling, matters dealing with heating, matters involving conveying and other systems matters either in general or as to details.

My invention will be best understood, together with additional objectives and advantages thereof, from the following description, read with reference to the drawings, in which.

Figure 1:
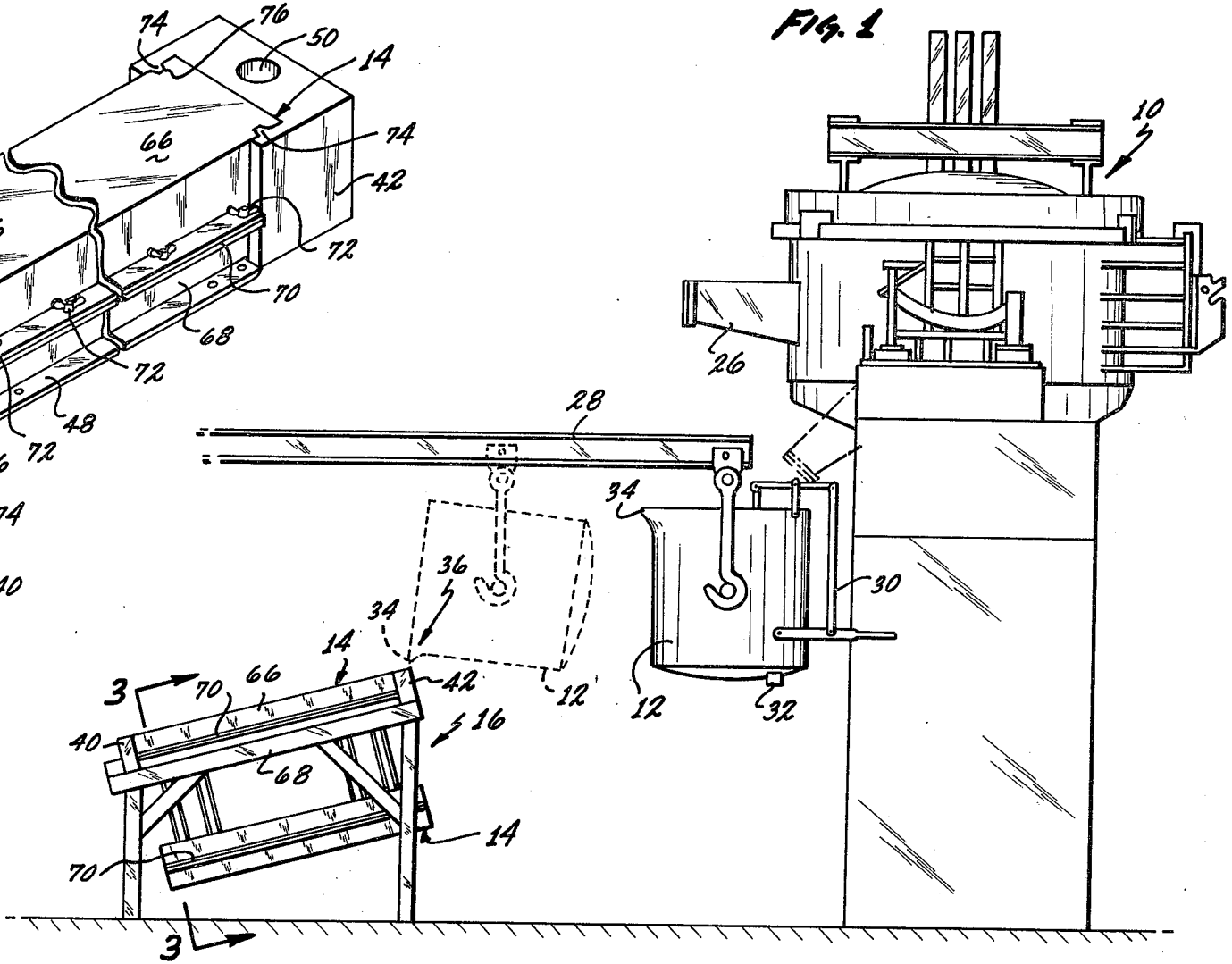
FIG. 1 is an elevational view of a specific embodiment of my new apparatus for producing rolled metal products.
Figure 4:
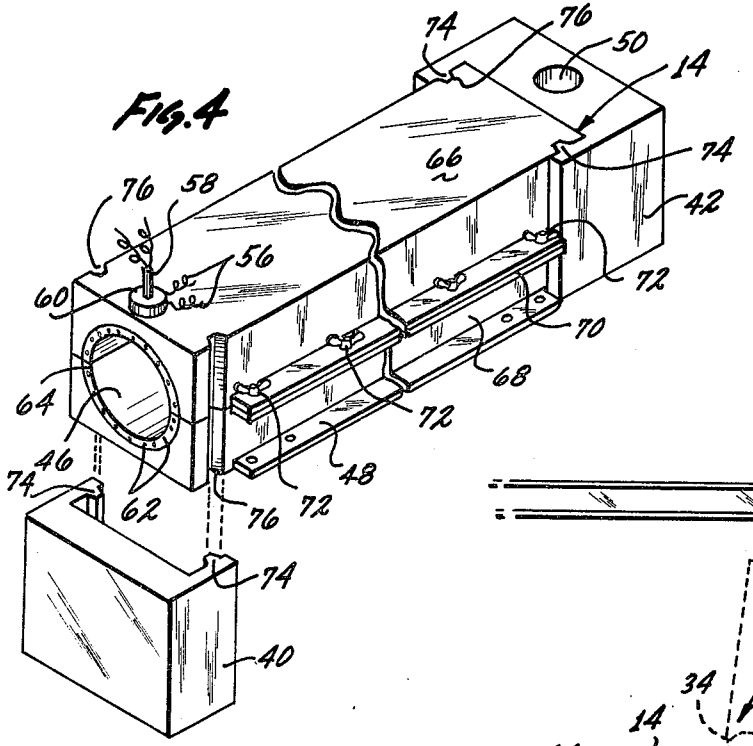
FIG. 4 is a partial perspective view of one of the molds, with one of its end caps in removed position.

Principal parts of my apparatus include:

(a) means to melt metal, such as an electrical induction furnace 10, (b) means to pour metal, which may be a separate ladle or pouring pot 12 rather than direct pouring from furnace 10, (c) a series of molds 14, (d) a conveyor 16 supporting the molds, (e) a hydraulic ram 18 to forcibly extract ingots 20 out of molds 14, and, (f) a rolling mill 22 having rolling stations shaping the ingots 20 into metal products 24.

As indicated before, my apparatus and process most often will be used with iron or steel, although use is not confined to those metals. Various products can be rolled from such metals in a rolling mill 22. For example, reinforcing steel can be formed from scrap or structural shapes can be formed from scrap or ore. In the specific embodiment of my invention shown in the drawings, I have illustrated an electrical induction furnace 10. As a standard furnace is indicated, I will not detail its parts other than to identify its pouring spout 26.

Rather than pour metal directly from furnace 10, I prefer to pour from a pouring pot or ladle 12. For example, more metal can be melting in furnace 10 while molds 14 are being serially poured from previously melted metal in ladle 12. If metal in ladle 12 should become too cool, such as in the event of a stoppage of conveyor 16 or mill 22, electrodes can be removed from furnace 10 and disposed in ladle 12 to add additional heat.

Ladle 12 is functionally represented and its construction will not be detailed as various ladles can be used. Ladle 12 is supported by a track 28. The lever arrangement 30 is of a type that may be used to move a stopper in a ladle having a bottom discharge opening 32. In dotted lines in FIG. 1, however, I have illustrated filling molds by tipping and pouring through spout 34.

Figure 3:
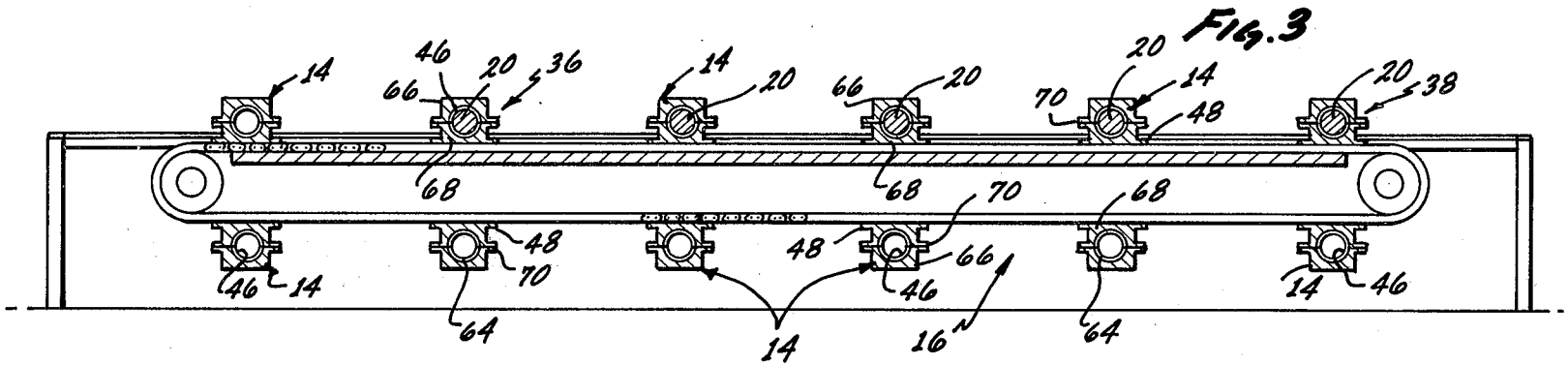
FIG. 3 is a view, partly in section, taken longitudinally of the conveyor as indicated by line 3—3 of FIG. 1.
Figure 6:
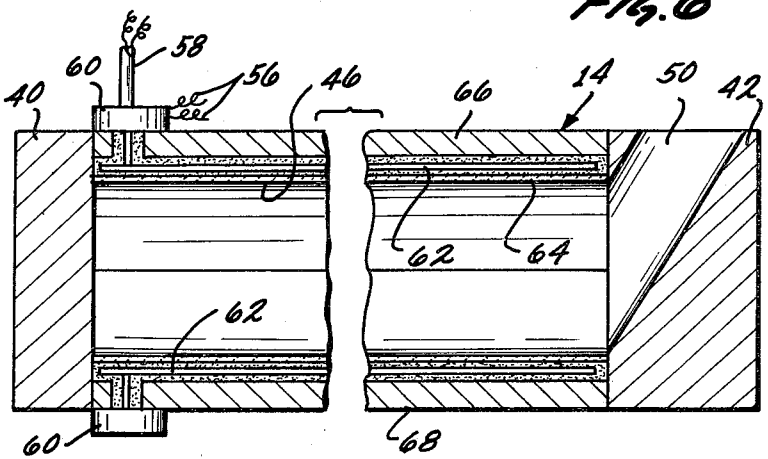
FIG. 6 is a longitudinal sectional view of one of the molds.
Figure 5:
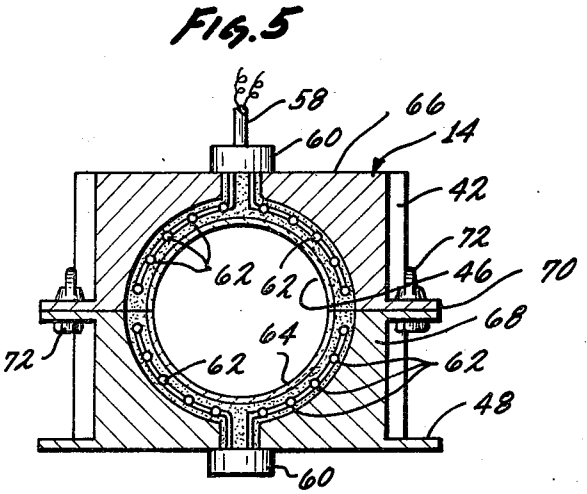
FIG. 5 is a transverse sectional view of one of the molds.

Molds 14 are serially poured at a first pouring station or location 36 and ingots 20 are extracted from molds 14 at a second extraction station or location 38 by use of hydraulic ram 18. In FIG. 3, it can be seen that the upper flight of molds 14 moving sidewise generally horizontally on conveyor 16 contain metal or ingots 20 from the point of pouring 36 to the point of extraction 38. The space between pouring station 36 and extraction station 38 is the mold and ingot cooling area.

Figures 2, 7:
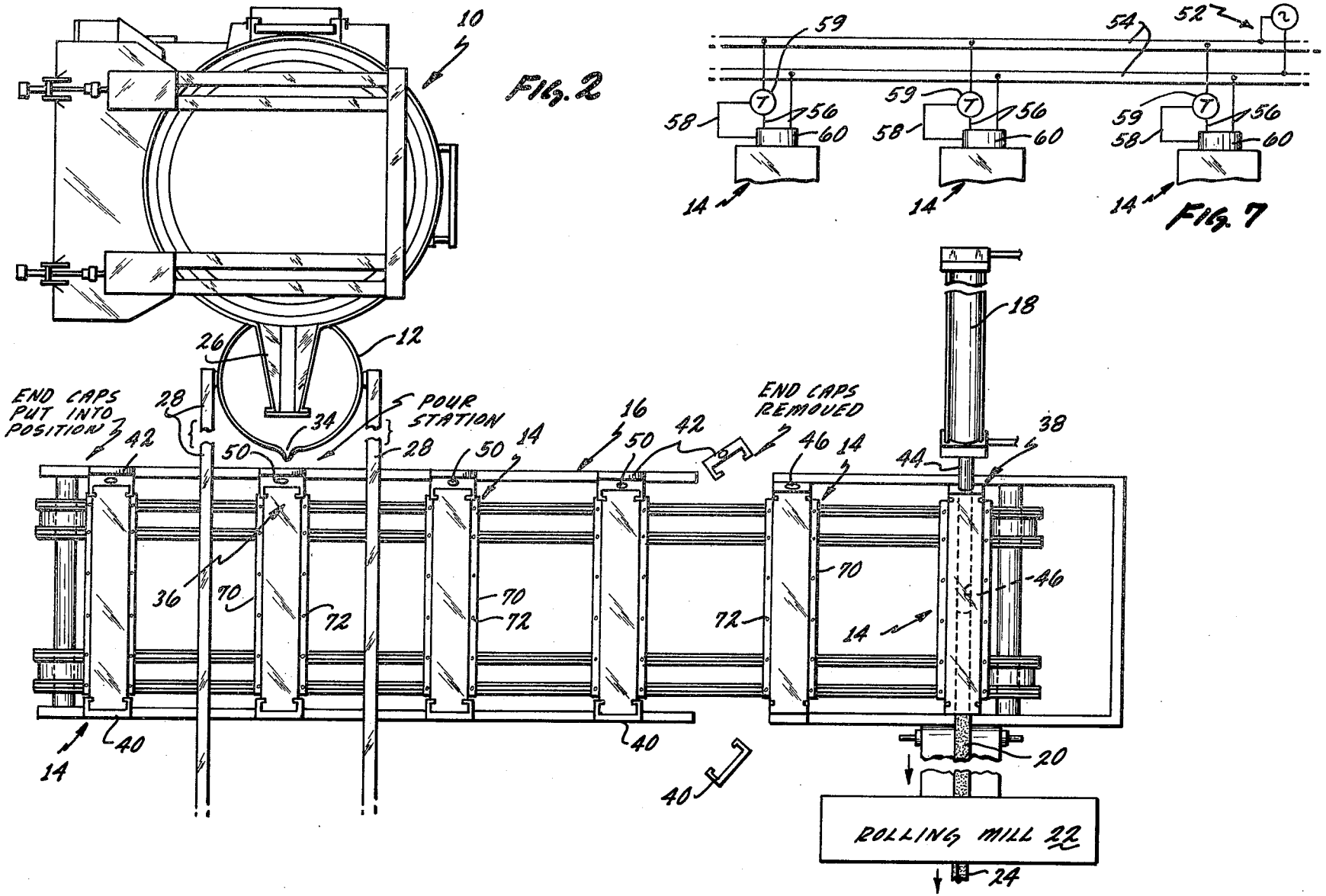
FIG. 2 is a top view.
FIG. 7 is a schemmatical view showing the mold electrical heating circuit.

Molds 14 have end caps 40, 42 that can be removed by the operator mechanically or with hand tools before ingot extraction, as illustrated particularly in FIG. 2. Hydraulic ram 18 has a piston plunger 44 which is operated at station 38 to move through the central longitudinal cavities 46 of molds 14 at that station, to extract ingots 20 which are moved endwise in the direction of rolling by ram 18 or other conveying means directly and immediately into rolling mill 22 where they are converted into products 24. Incidentally, longitudinal mold cavities 46 preferably are tapered oppositely to the direction of ingot extraction, in order to facilitate extraction by the hydraulic ram without opening of the molds other than their end caps 40, 42.

Conveyor 16 conveys mold 14 from the pouring or filling station 36 to the second extraction station or location 38. In fact, the drawings show molds 14 to be attached to conveyor 16 by flanges 48 to travel an endless path, as particularly indicated in FIG. 3. As conveyor 16 is conventional, its construction will not be detailed. Attention is particularly called to FIG. 1, however, where it is shown that the conveyor preferably is tipped transversely so that the molds are tipped to positively feed molten metal from the pouring sprues 50 to completely fill the mold cavities 46 and so that the sprue passages in effect act as hot tops. The art of making and handling molds in general is a subject separate from the present invention and molds 14 can be further configured according to the learning of those skilled in the art of such molds. For example, the metal in sprue passages 50 can be separated from the ingot in mold longitudinal cavities 46 either by removing mold end cap 42 before the metal is too solidified for ready removal of cap 42 or by necking sprue 50 adjacent to cavity 46 to facilitate breaking off the metal in sprue 50 (in which case passage 50 should be tapered in a downstream direction to facilitate sprue passage metal extraction in an upstream direction).

As before indicated, the system thus far described is unworkable because the side surfaces of ingots 20 will be at too low a temperature for good rolling mill operation by the time the centers of the ingots reach a temperature for good rolling mill operation. To the extent both exterior and interior temperatures are within rolling tolerance, the time, if any, that the temperatures are suitable is too short or the temperatures are too difficult to measure for practical continuous operation from metal pouring to rolling mill product production.

One of my conceptions was that it is not necessary that the exterior side surfaces of ingots 20 be permitted to go below good rolling temperature in order for the center of ingots 20 to reach a good rolling temperature. I accomplish this by heating such exterior side surfaces as needed to maintain whatever minimum temperature is needed for rolling. I am not specifying such temperatures herein because temperatures can vary according to the metal being handled and because rolling mill operations involve knowhow of those skilled in the art as to temperatures and other factors, so that it is not appropriate for me in this specification to generally instruct operators on operations of rolling mills. An illustration would be a metal that melts and is poured at about 2500° F. and has solidified enough to be rolled at about 1800° F., which is a minimum temperature for rolling the metal. In other words, the metal would be at a temperature of at least 2500° F. in furnace 10 and ladle 12 and would be poured at pour station 36 in molds 14 at about that temperature. The molds 14 might take as long as an hour, in the cooling area, to go from pour station 36 to extraction station 38 and there are a series of molds 14 moving sidewise between station 36 and station 38, in the cooling area, at all times during operation of my new apparatus and method. The temperature of extracted ingots 20 at station 38 should be a minimum of but close to 1800° F., from core to exterior surfaces, in order to best be rolled in mill 22. I will now detail my apparatus used to maintain the exterior side surfaces of ingots 20 at the minimum temperature, e.g., 1800° F., while the centers of ingots 20 are reducing in temperature to close to suitable rolling temperature.

I provide means to heat the exterior side surfaces of ingots 20 in molds 14 for all or part of the travel of molds between station 36 and station 38. The end surfaces of ingots 20 usually won't be a problem as to direct heating as their cross-sectional areas are relatively small, heat will be conducted from ingot side surfaces, etc. The minimum temperature to be maintained on the side surface of ingots 20, as the ingot cores cool, will depend on the metal to be rolled. Other variables in the heating process include: the size of molds 14, particularly as to the cross-sectional sizes of mold cavities 46; the time of travel from station 36 to 38 (not only optimum time but also the time that may be required due to factors other than mold cooling; such as speed of operation of rolling mill 22, any breakdown, etc.); type of heating; operator, semi-automatic or automatic control; quality requirements of products relative to optimum rolling temperatures, etc.

I prefer electrical heating of ingots 20. FIG. 7 diagrammatically illustrates a specific embodiment of an electrical heating system generally including an A-C electrical energy source 52 connected to bus bars 54. The electrical connections 56 from molds 14 may be taken as including shoes making sliding contacts with bars 54. The distance of heating between stations 36 and 38 (all or part of the distance) could be automatically determined by the length of bars 54. On the other hand, the distance of heating could be a matter for operator control whether bus bar or other means of electrical connectionsto the power source 52 were used. Likewise, heating responsive to temperature at the outer surfaces of ingots 20 could be variously provided for, i.e., a thermostatic switch could be provided in each mold connection 56 so that electrical energy would only be applied when ingot surface temperatures reached a selected minimum temperature. Alternatively, the operator could read temperatures and apply heating as needed. I indicate a temperature probe and electrical circuit including heat gauge at 58, centrally of one of the mold bosses 60 for electrical connections, temperature probes, etc., to the interiors of molds 14. The element 59 in FIG. 7 represents a thermostatically controlled switch operating respective to temperatures sensed by probe circuit 58 automatically to activate and deactivate heating of mold 14, but, as indicated, heating instead could be operator controlled.

Carbon rod heating elements 62 are illustrated, embedded in refractory liners 64 in molds 14. Refractory liners 64 are used not only to support rods 62 but also to be replacable elements to increase the lives of molds 14, i.e., the molds 14 would need replacement more often if metal were poured into direct contact with interior metal cavity surfaces. From the foregoing, it will be understood that heating of exterior side surfaces of ingots 20 can be provided as needed to prevent those surfaces from reaching temperatures below rolling temperatures before the centers of the ingots reach rolling temperatures.

Molds 14 are preferably divided into upper and lower halves 66, 68 which have flanges 70 secured together by bolts and wing nuts 72. Dividing of molds 14 permits convenient installation and removal of refractory liners 64. End caps 40, 42 are secured to molds 14 by flanges 75 fitting in mold grooves 76.

My new apparatus and method for producing rolled metal products without reheating ingots will be understood from the foregoing description.

Having thus described my invention, I do not wish to be understood as limiting myself for the exact details of construction shown but instead wish also to cover modifications thereof that will occur to those skilled in the art upon learning of my invention and which properly are within the scope of my invention.

I claim:

1. The process of producing rolled metal products without reheating ingots, comprising:
(a) melting metal and providing a quantity of molten metal at a first pouring station,
(b) providing a series of separate molds and conveying said molds on an endless path and bringing said molds serially past said first station and serially, individually pouring said molds at said first station,
(c) moving said molds serially from said first station through a cooling area to a second ingot-extraction station and during operation of the process providing a series of molds at all times in said cooling area,
(d) applying heat to the exterior side surfaces of the metal in said molds during at least the major portion of the movement of said molds from said first to said second station and applying sufficient heat to prevent reduction of temperature of said exterior side surfaces of the metal in said molds below a selected minimum temperature which is a temperature suitable for rolling, and
(e) extracting the metal in said molds as ingots at said second station and immediately rolling said ingots producing said products.

2. In the process of claim 1, moving said molds sidewise in moving said molds from said first to said second station and extracting said ingot endwise of said molds and in the direction of rolling.

3. The process of producing rolled metal products without reheating ingots, comprising:
(a) melting metal and providing a quantity of molten metal at a first pouring station,
(b) providing a series of separate molds and conveying said molds serially past said first station and serially, individually pouring said molds at said first station,
(c) moving said molds serially from said first station through a cooling area to a second ingot-extraction station,
(d) applying heat to the exterior side surfaces of the metal in said molds to prevent reduction of temperature of said exterior side surfaces of the metal in said molds in said cooling area below a selected minimum temperature which is a temperature suitable for rolling, and
(e) extracting the metal in said molds as ingots at said second station and immediately rolling said ingots producing said products.

4. Means for producing rolled metal products without reheating ingots, comprising:
(a) means operative to melt metal and means operable to pour the melted metal at a first pouring station,
(b) an endless conveyor having a flight passing in a generally horizontal direction from said first station through a cooling area to a second ingot-extraction station,
(c) a series of molds secured to said conveyor and having sprues oriented at said first station for mold pouring, said molds having removable end caps, and a powered plunger at said second station disposed to extract ingots from said molds at said second station,
(d) a rolling mill disposed adjacent to said second station operative to receive ingots from said molds and to roll the ingots into metal products, and
(e) heating means operative to heat the side surfaces of metal in said molds to a minimum temperature suitable for rolling at least for the last portion of travel of molds in said cooling area to said second ingot-extraction station, whereby ingots extracted from said molds will not have to be reheated before rolling.

5. The subject matter of claim 4 in which said molds extend laterally of said conveyor and the direction of extraction of said ingots is in the direction of rolling.

6. The subject matter of claim 4 in which said conveyor is laterally slanted and said sprues are at the high ends of said molds.

7. The subject matter of claim 4 in which said molds are divided into halves that are included in said cooling area a lower half secured to said conveyor and an upper half secured on the lower half, the side surfaces of said mold at each end having upright grooves and said mold having at each end an end cap with flanges fitting in said grooves to secure said end caps in place said end caps being removed by forcing said flanges out of said grooves, and the interior walls of said mold being tapered in a direction away from said rolling mill to facilitate ingot-extraction.

8. The subject matter of claim 7 in which said heating means include electrical resistance elements and means operative to apply energy to said elements as needed including thermostatic means controlling electrical activation depending on the temperatures of the side surfaces of metal in said molds.

9. The subject matter of claim 8 in which said mold is lined with refractory material and said electrical resistance elements are embedded in said refractory material.

10. The subject matter of claim 4 in which said plunger is hydraulically powered and is extendible lengthwise through the cavities of said molds.

11. Means for producing rolled metal products without reheating ingots, comprising:
(a) means operative to melt metal and means operable to pour the melted metal at a first pouring station,
(b) a conveyor having a flight passing from said first station through a cooling area to a second ingot-extraction station,
(c) a series of molds supported by said conveyor and having sprues oriented at said first station for mold pouring, said molds having removable end caps, and means at said second station operative to extract ingots from said molds at said second station,
(d) a rolling mill disposed adjacent to said second station operative to receive ingots from said molds and to roll the ingots into metal products, and
(e) means operative to heat exterior surfaces of metal in said molds to a minimum temperature suitable for rolling at least for the last portion of travel of molds in said cooling area to said second ingot-extraction station, whereby ingots extracted from said molds will not have to be reheated before rolling.

12. Means for producing rolled metal products without reheating ingots, comprising:

(a) means operable to pour the molten metal at a first pouring station, (b) a conveyor having a flight passing from said first station through a cooling area to a second ingot-extraction station, (c) a series of molds supported by said conveyor and having sprues oriented at said first station for mold pouring, and means at said second station operative to extract ingots from said molds, (d) a rolling mill operative to receive ingots from said molds and to roll the ingots into metal products, and (e) means operative to heat exterior side surfaces of metal in said molds in said cooling area to maintain a minimum temperature suitable for rolling whereby ingots extracted from said molds will not have to be reheated before rolling.

* * * * *